US007187105B2

(12) United States Patent
Shiba

(10) Patent No.: US 7,187,105 B2
(45) Date of Patent: Mar. 6, 2007

(54) TRANSDUCER WITH COUPLED VIBRATORS

(75) Inventor: Hiroshi Shiba, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 11/152,424

(22) Filed: Jun. 14, 2005

(65) Prior Publication Data

US 2005/0275312 A1 Dec. 15, 2005

(30) Foreign Application Priority Data

Jun. 15, 2004 (JP) ..... 2004-176550

(51) Int. Cl.
*H04R 17/10* (2006.01)

(52) U.S. Cl. ..... 310/325; 381/347; 381/348

(58) Field of Classification Search ..... 310/325; 381/347, 348

See application file for complete search history.

(56) References Cited

U.S. PATENT DOCUMENTS

2003/0118195 A1* 6/2003 Hama ..... 381/71.1

FOREIGN PATENT DOCUMENTS

| | | | |
|---|---|---|---|
| JP | 2001148896 A | * | 5/2001 |
| JP | 2003032771 A | * | 1/2003 |
| JP | 3406986 | | 3/2003 |
| JP | 2003174695 A | * | 6/2003 |
| JP | 2004312119 A | * | 11/2004 |

* cited by examiner

*Primary Examiner*—Darren Schuberg
*Assistant Examiner*—J. Aguirrechea
(74) *Attorney, Agent, or Firm*—Scully, Scott, Murphy & Presser, P.C.

(57) ABSTRACT

A transducer includes a Langevin type vibrator, a bending vibrator, and a ring-like member. The Langevin type vibrator has a construction in which a front mass, a cylindrical vibrator, and a rear mass are provided in tandem, and those elements are tightened by a bolt. The bending vibrator is provided apart from the front mass. The ring-like member is provided in outer peripheral portions of the front mass and the bending vibrator to couple the front mass and the bending vibrator to each other. The transducer generates a large sound pressure over a wide frequency band since a sound wave radiation surface is wide and its amplitude amount is large.

10 Claims, 7 Drawing Sheets

TRANSDUCER WITH COUPLED VIBRATORS

BACKGROUND OF THE INVENTION

1. Field of the Invention

The present invention relates to a transducer having a bolted Langevin type vibrator, and more particularly to an acoustic transducer which is capable of obtaining a sound pressure level equal to or higher than a given level over a wide frequency band.

2. Description of the Related Art

At present, a miniature bolted Langevin type sonic transducer which can transmit a high power sound wave is used as an acoustic transducer for use in water. FIG. 1 shows a cross sectional view of an example of a conventional bolted Langevin type sonic transducer disclosed in JP 3,406,986 B. The sonic transducer includes a bending vibrator 2 and a Langevin type vibrator 3. The bending vibrator 2 has a disc type active diaphragm 4 and a diaphragm 5 having a cavity in its inside. The diaphragms 4 and 5 are bonded to each other through an adhesive agent. The Langevin type vibrator 3 has a cylinder type active vibrator 9, a rear mass 7, a front mass 6, and a bolt 8. The front mass 6, a plurality of cylinder type active vibrators 9 and the rear mass 7 are provided in tandem. The bolt 8 tightens those constituent elements. The disc type active diaphragm 4 is located within a concave portion in a front face of the front mass 6. The diaphragm 5 is welded to the front mass 6 through a joining portion 60. When the disc type active diaphragm 4 vibrates, the diaphragm 5 vibrates to radiate a sound wave. In addition, the transducer includes a phase shifter 10 for shifting a phase of a driving voltage applied to the disc type active diaphragm 4.

The above-mentioned transducer has three vibration modes: a bending vibration mode of the bending vibration 2 at a frequency fa; a longitudinal vibration mode of the Langevin type vibrator 3 at a frequency fb; and a bending vibration mode of a front face plate (an uppermost portion in FIG. 1) of the vibrator 5 at a frequency fc. Normally, those frequencies show a relationship of fa<fb<fc. The transducer is driven so that the longitudinal vibration mode of the Langevin type vibrator 3 becomes opposite in phase with respect to the bending vibration mode of the bending vibrator 2. Thus, the vibration modes are superposed, and the transducer operates at a frequency of a wide frequency band.

However, this transducer involves the following problem. FIGS. 2A to 2C shows examples of vibrations of the transducer. When a size of the transducer is not changed, a sound pressure level in a first resonance frequency f1' based on the bending vibration mode (FIG. 2A) of the bending vibrator 2 is low in a low frequency region because an area of the bending vibration 2 is small in the low frequency region with respect to a wavelength thereof. Moreover, the sound pressure level is remarkably reduced in an intermediate frequency f' region between a second resonance frequency f2' based on the longitudinal vibration mode (FIG. 2C) of the Langevin type vibrator 3 and the first resonance frequency f1'. This reason resides in that since the Langevin type vibrator 3 and the bending vibrator 2 are integrated with each other, the vibration modes of the Langevin type vibrator 3. and the bending vibrator 2 are coupled to each other. As shown in FIG. 2B, a sound radiation area (an area α in FIG. 2B) due to the bending vibration mode of the bending vibrator 2 and a sound radiation area (an area β in FIG. 2B) due to the longitudinal vibration mode of the Langevin type vibrator 3 vibrate in directions opposite to each other to cancel the sound pressures of the area α and the area β.

SUMMARY OF THE INVENTION

A transducer of the present invention with which the above-mentioned problem is solved includes a vibrator having a construction in which a front mass, a cylindrical vibrator, and a rear mass are provided in tandem, and the front mass, the cylindrical vibrator, and the rear mass are tightened by a bolt. The transducer further includes a bending vibrator which is provided apart from the front mass, and a ring-like member which is provided in an outer peripheral portion of the front mass and the bending vibrator to couple the front mass and the bending vibrator to each other. The ring-like member may have a ring-like vibrator. The transducer increases a sound pressure over a wide frequency band.

BRIEF DESCRIPTION OF THE DRAWINGS

The above and other objects, features and advantages of the present invention will become apparent from the following detailed description when taken with the accompanying drawings in which.

DETAILED DESCRIPTION OF THE PREFERRED EMBODIMENTS

Figure 1:
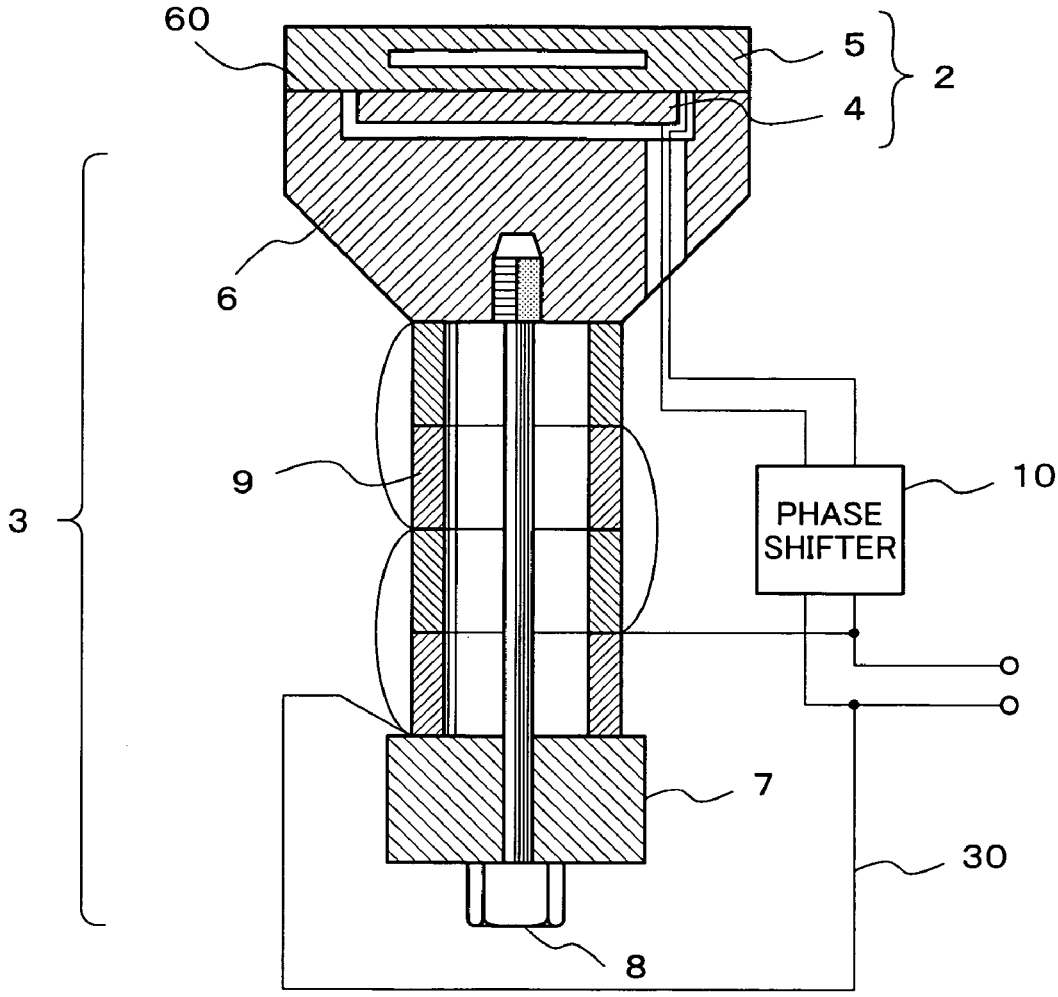
FIG.1 PRIOR ART
FIG. 1 is a cross sectional view of an example of a conventional transducer.
Figure 2C:
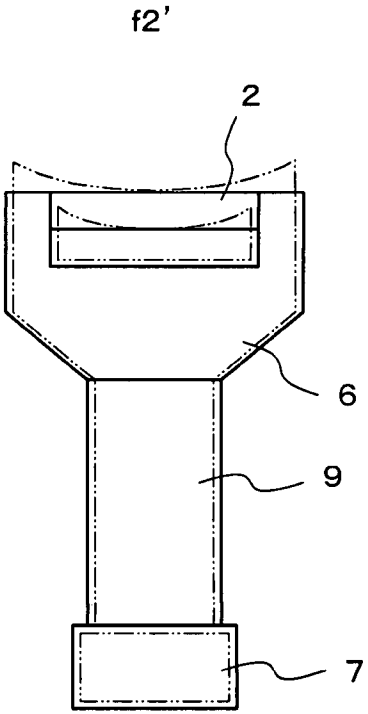
FIG.2C PRIOR ART
FIGS. 2A to 2C are views showing examples of vibrations of the conventional transducer.
Figure 2B:
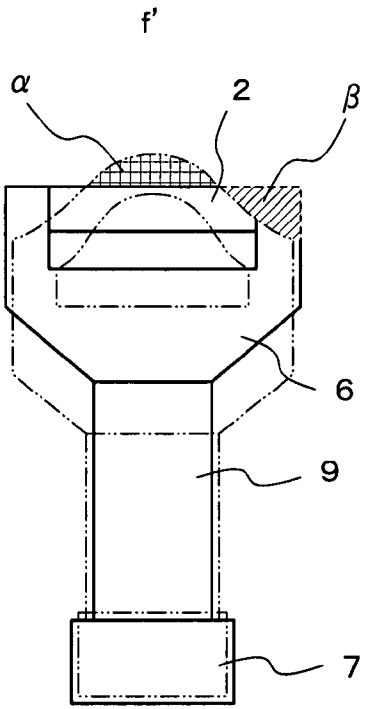
FIG.2B PRIOR ART
Figure 2A:
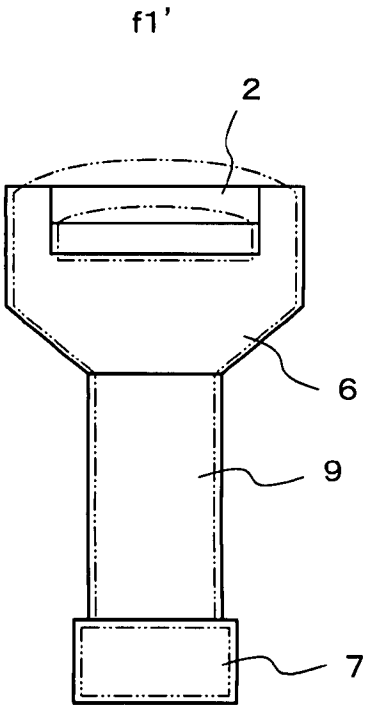
FIG.2A PRIOR ART
Figure 3:
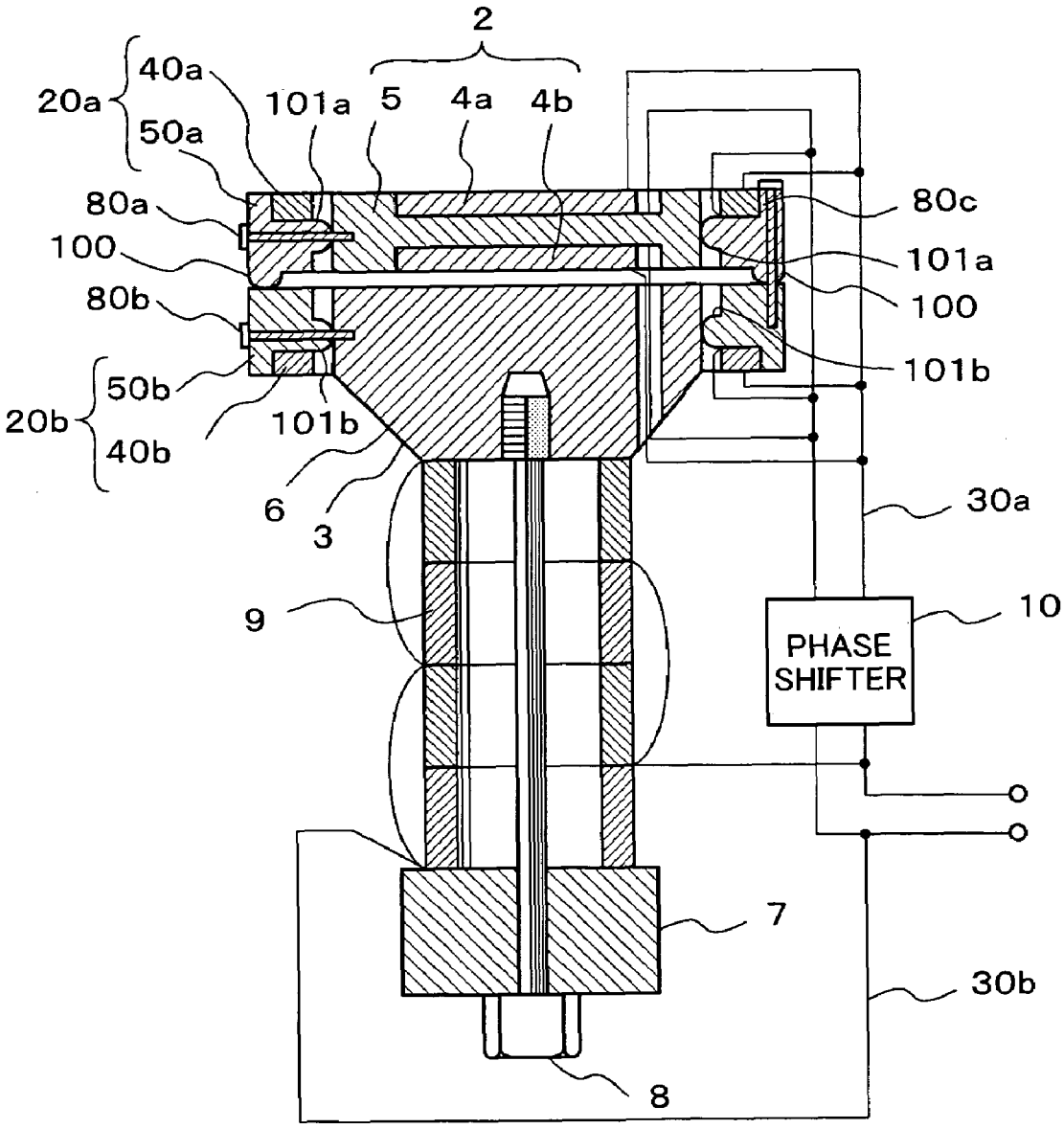
FIG. 3 is a cross sectional view of a transducer according to an embodiment of the present invention.

Preferred exemplary embodiments of the present invention will hereinafter be described in detail with reference to the accompanying drawings. Referring to FIG. 3, a transducer according to an exemplary embodiment of the present invention includes a Langevin type vibrator 3 and a bending vibrator 2. The Langevin type vibrator 3 includes a front mass 6, a rear mass 7, and a plurality of cylinder type active vibrators 9 which are provided between the front mass 6 and the rear mass 7. A bolt 8 tightens the front mass 6, the rear mass 7, and the cylinder type active vibrators 9. The bending vibrator 2 is provided so as to leave a predetermined space between the bending vibrator 2 and a front face of the front mass 6. The bending vibrator 2 has a construction in which disc type active vibrators 4*a* and 4*b* are stuck on both side faces of the vibrator 5, respectively. Displacement enlarging mechanisms 20*a* and 20*b* are provided in outer peripheral portions of the bending vibrator 2 and the front mass 6, respectively. The displacement enlarging mechanisms 20*a* and 20*b* couple the bending vibrator 2 and the front mass 6 to each other. The displacement enlarging mechanism 20*a* is an annular member provided in an outer peripheral portion of the bending vibrator 2, and includes an annular vibrating member 50*a* and an annular active vibrator 40*a*. A convex-like supporting portion 101*a* is formed inside the annular vibrating member 50*a*. The convex-like supporting portion 101*a* and an outer peripheral surface of a diaphragm 5 are coupled to each other by a screw 80*a*. The displacement enlarging mechanism 20*b* is an annular member provided in an outer peripheral portion of the front mass 6, and includes an annular vibrating member 50*b* and an annular active vibrator 40*b*. A convex-like supporting portion 101*b* is formed inside the annular vibrating member 50*b*. The convex-like supporting portion 101*b* and an outer peripheral portion of the front mass 6 are coupled to each other by a screw 80*b*. The annular vibrating members 50*a* and 50*b* are coupled to each other in a convex-like supporting portion 100 formed in the annular vibrating member 50*a* by a screw 80*c*.

Electrodes (not shown) which are formed in the disc type active vibrators 4*a* and 4*b*, and the annular active vibrators 40*a* and 40*b*, respectively, are connected to a phase shifter 10 through a lead 30*a*. Likewise, electrodes (not shown) of the cylinder type active vibrators 9 are connected to the phase shifter 10 through a lead 30*b*. The bending vibrator 2 has a bimorph construction. The disc type active vibrators 4*a* and 4*b* are perpendicularly polarized in directions opposite to each other and excite a vibration having a diameter broadening vibration mode. The cylinder type active vibrators 9 are provided so that they are perpendicularly polarized, and their polarization directions are opposite to each other. The cylinder type active vibrators 9 are electrically connected in parallel with each other.

Figure 4:
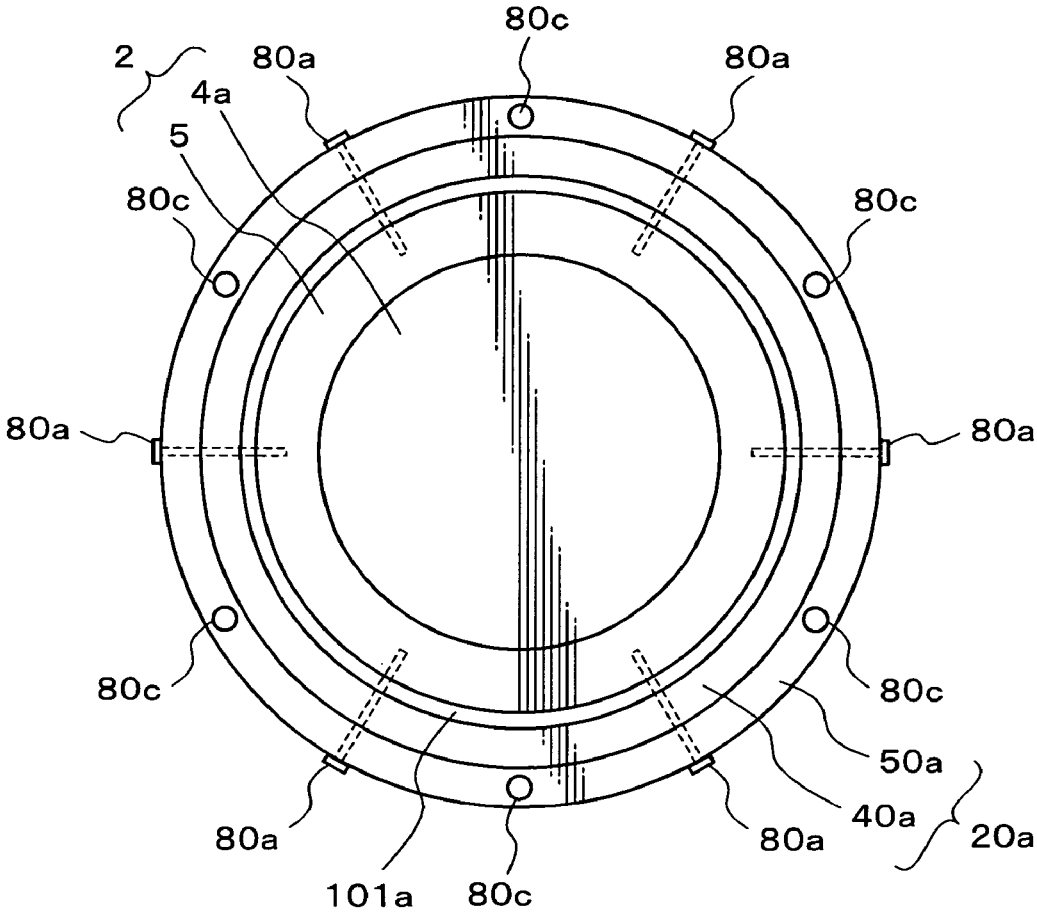
FIG. 4 is a view showing a sound radiation surface of the transducer according to the example of the present invention.

FIG. 4 shows a front face portion of the transducer of this exemplary embodiment. The bending vibrator 2 includes a diaphragm 5 and a disc-like active vibrator 4*a* which is provided in a center of the diaphragm 5. Six screws 80*a* couple the annular vibrating member 50*a* and the diaphragm 5 to each other. Moreover, six screws 80*c* couple the annular vibrating members 50*a* and 50*b* to each other. When the transducer is driven, the annular vibrating member 50*a* and the diaphragm 5 fixed by the six screws 80*a*, and the annular vibrating members 50*a* and 50*b* fixed by the six screws 80*c* can vibrate.

The above-mentioned transducer, for example, is adjusted as follows. A construction having the bending vibrator 2 and the displacement enlarging mechanism 20*a* vibrates in a bending vibration mode with a convex-like supporting portion 100 as a supporting point. A resonance frequency of the bending vibration mode is f1. A resonance frequency of a longitudinal vibration mode depending on a total length of the transducer is f2. At this time, the transducer is adjusted in advance so that the resonance frequency f1 becomes lower than the resonance frequency f2. A resonance frequency f" of the bending vibration mode of the bending vibrator 2 made with the convex-like supporting portion 101*a* as the fulcrum is adjusted so as to become an intermediate frequency between the resonance frequencies f1 and f2. A piezoelectric ceramics made of lead zirconate titanate is used as a material of each of the disc type active vibrators 4*a* and 4*b*, the annular active vibrators 40*a* and 40*b*, and the cylinder type active vibrator 9. An aluminum alloy is used as a material of each of the diaphragm 5, the displacement enlarging mechanisms 50*a* and 50*b*, the front mass 6, and the rear mass 7. Stainless steel is used as a material of the bolt 8, and the fixing screws 80*a*, 80*b*, and 80*c*. When a set normalized frequency is f, the velocity of sound is C, a wavelength is $\lambda(=C/f)$, a diameter (of a portion having a maximum size) is $\Phi$, and a total length is L, the sizes of the members are set so as to fulfill a relationship of $\Phi=0.15\lambda$ and $L=0.45\lambda$. In addition, the sizes of the portions of the transducer are set so that a relationship between the resonance frequencies f1 and f2 is expressed by $f2=(1/3)f1$.

An example of an operation of the transducer will hereinafter be described. In the conventional transducer, a peripheral portion of the bending vibrator 2 and the front mass 6 are coupled to each other. The bending vibrator 2 vibrates with the coupling portion as a node. For this reason, the sound radiation area of the front face of the bending vibrator 2 is limited. However, in the transducer of the present invention, the bending vibrator 2 and the front mass 6 are provided apart from each other, and the bending vibrator 2 vibrates with the convex-like supporting portion 100 in the displacement enlarging mechanisms 20*a* and 20*b* as a node. The node of the bending vibrator 2 of the present invention is located in a more outer side than the node of the bending vibrator 2 of the conventional transducer is located. Consequently, an area of the sound radiation area of the bending vibrator 2 becomes large. For this reason, the transducer of the present invention can generate a large sound pressure in a low frequency region. In addition, the transducer of the present invention can increase an amplitude amount of bending vibrator 2 because of the adoption of the above-mentioned construction. The large amplitude amount leads to generation of the large sound pressure.

Figure 5C:
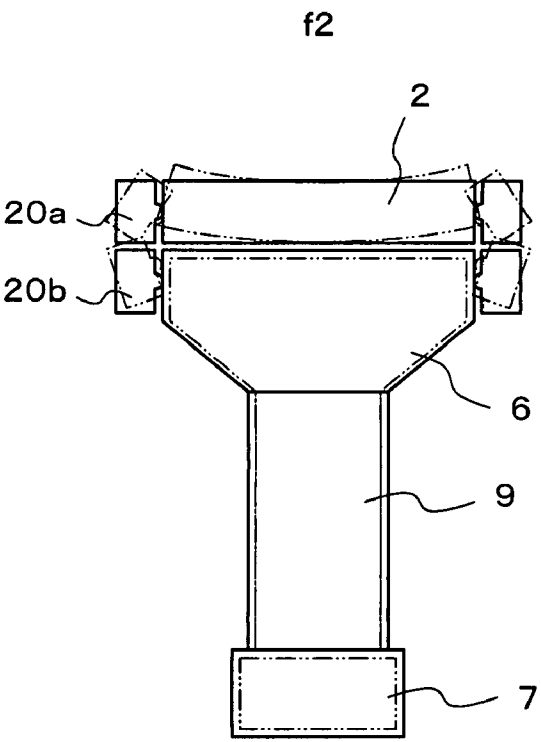
FIGS. 5A to 5C are views showing an example of a vibration of the transducer according to the example of the present invention.
Figure 5B:
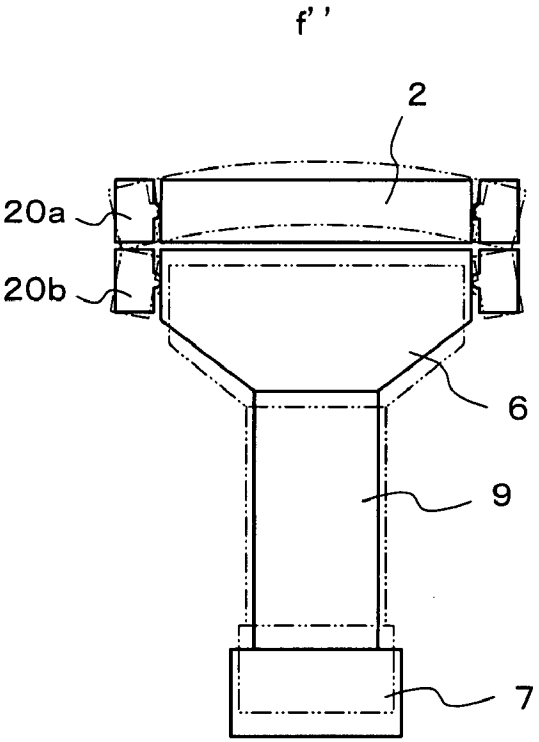
Figure 5A:
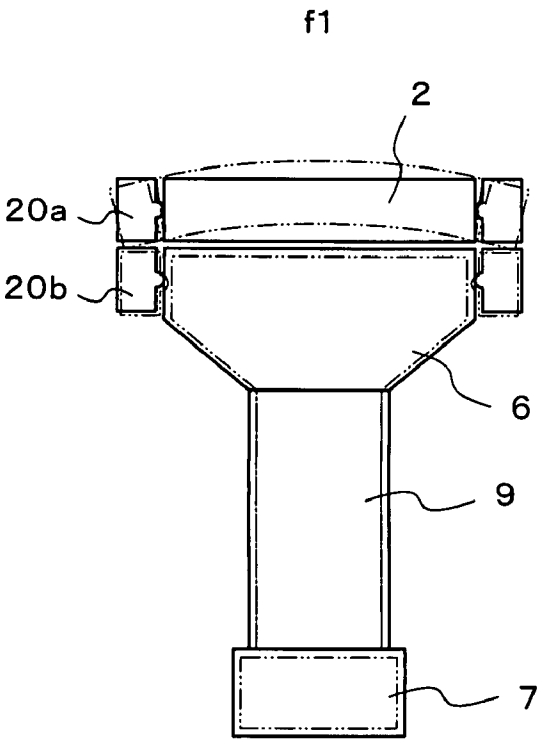

FIGS. 5A to 5C show examples of the vibration modes of the transducer according to this exemplary embodiment of the present invention. The phase shifter 10 supplies an electrical signal to each of the disc type active vibrators 4*a* and 4*b*, and the annular active vibrators 40*a* and 40*b*. This electrical signal generates a bending vibration mode (having a mechanical resonance frequency f1) of the construction having the bending vibrator 2 and the displacement enlarging mechanism 20*a*. As shown in FIG. 5A, the bending vibration mode is a vibration mode which is generated with the convex-like supporting portion 100 as a node. At this time, a sound wave is radiated from a front surface of the bending vibrator 2. Since the bending vibrator 2 has the bimorph construction, the vibrator 2 generates a large bending vibration. Moreover, a displacement amount of construction having the bending vibrator 2 and the displacement enlarging mechanism 20*a* is also increased by the displacement enlarging mechanism 20*a*.

Next, a frequency of the electrical signal is increased to reach the above-mentioned frequency f". At this time, the construction having the bending vibrator 2 and the displacement enlarging mechanism 20*a* vibrates in the bending vibration mode. At the same time, the Langevin type vibrator 3 generates a longitudinal vibration mode in which a plurality of cylinder type active vibrators 9 expand and contract. The phase shifter 10 controls the electrical signal so that the disc type active vibrators 4*a*, 4*b*, the annular active vibrators 40*a*, 40*b*, and the Langevin type vibrator 3 are driven so as to be opposite in phase with respect to each other. As shown in FIG. 5B, when the Langevin type active vibrator 3 in the longitudinal vibration mode contracts in this vibration operation, the bimorph type bending vibrator 2, and the displacement enlarging mechanisms 20*a* and 20*b* expand. The front face of the bimorph type bending vibrator 2 carries out the vibration in the bending mode so as to show a convex-like shape in the front. At this time, the displacement enlarging mechanisms 20*a* and 20*b* radially vibrate in conjunction with the bending vibrator 2. A diameter of the convex-like supporting portion 100 also expands and contracts in conjunction with the vibrations of the displacement enlarging mechanisms 20*a* and 20*b*. As a result, the vibration of the bending vibrator 2 in the bending mode enlarges.

As shown in FIG. 5C, when the frequency of the electrical signal further increases to reach the frequency f2, the vibration of the overall transducer including the bending vibrator 2, the displacement enlarging mechanisms 20*a* and 20*b*, and the Langevin type vibrator 3 in the longitudinal vibration mode becomes large. At this time, the sound wave is radiated toward the front of the bending vibrator 2.

Figure 6:
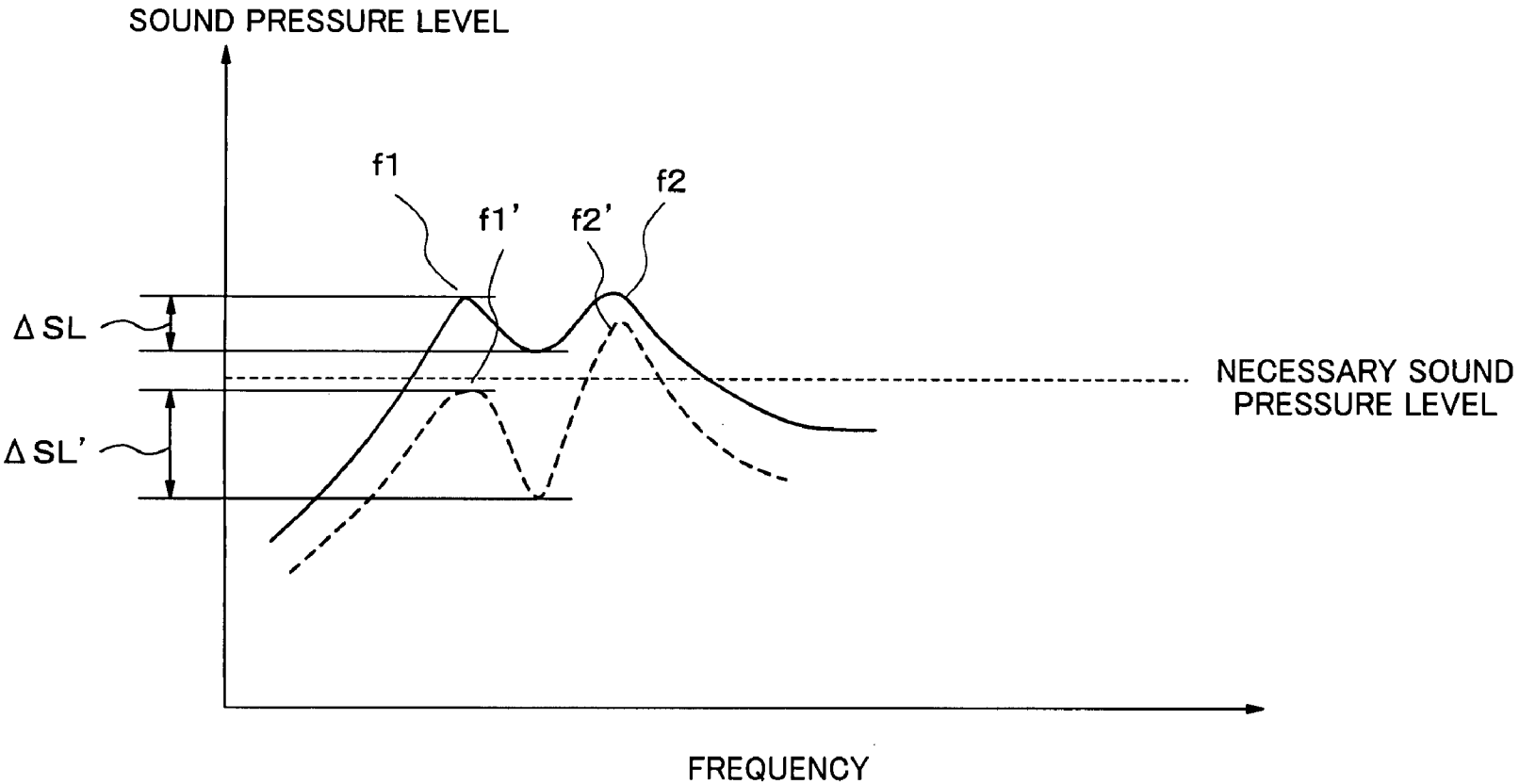
FIG. 6 is a graphical representation showing a relationship between a sound pressure level and a frequency of the transducer.

FIG. 6 shows a relationship between the sound pressure level and the frequency with respect to the transducer of the present invention and the conventional transducer. In FIG. 6, a broken line represents the characteristics of the conventional transducer, and a solid line represents the characteristics of the transducer of the present invention. In a low frequency region, a sound pressure of the transducer of the present invention at the resonance frequency f1 is larger than that of the conventional transducer at the resonance frequency f1'. In addition, a reduction amount, ΔSL, of sound pressure level of the transducer of the present invention in a frequency region between the first resonance frequency f1 and the second resonance frequency f2 is smaller than a reduction amount, ΔSL', of sound pressure level of the conventional transducer in the frequency region between the first resonance frequency f1 and the second resonance frequency f2. This characteristic shows that the transducer of the present invention can realize the necessary sound pressure level over a wide frequency range.

The reason that the transducer of the present invention can maintain the necessary sound pressure in the frequency region between the first resonance frequency f1 and the second resonance frequency f2 is as follows. The sound pressure is proportional to an area of a sound wave radiation surface and a vibration amplitude amount of sound wave radiation surface, and is inversely proportional to a square of a wavelength. That is, the area of the sound wave radiation surface and the vibration amplitude amount of sound wave radiation surface increase the sound pressure. In the transducer of the present invention, when the bimorph type bending vibrator 2 carries out the bending vibration with the convex-like supporting portion 100*a* as the fulcrum, the annular active vibrations 40*a* and 40*b* radially, elastically vibrate synchronously with the bending vibration. At this time, the bending vibration of the bending vibrator 2 is enlarged and amplified. As a result, an amplitude amount of bending vibrator 2 increases. In addition, since the bending vibrator 2 is not directly coupled to the front mass 6, the area of the sound wave radiation surface of the bending vibrator 2 is largely increased as compared with the case of the conventional transducer. The sound pressure is not reduced in the intermediate frequency region between the first resonance frequency f1 and the second resonance frequency f2 due to those constructions and the operation.

Figure 7:
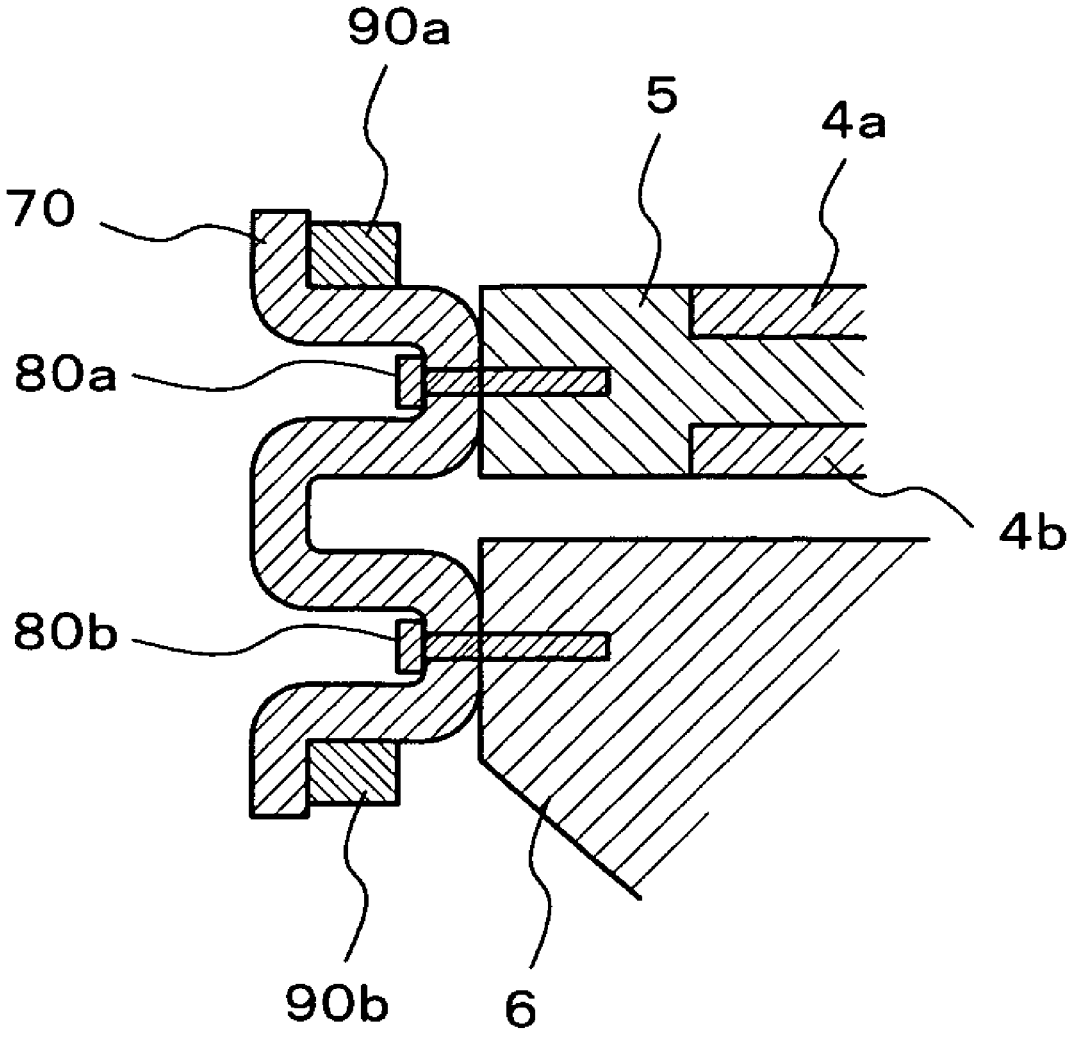
FIG. 7 is a partial cross sectional view of a transducer according to another example of the present invention.

FIG. 7 is a partially cross sectional view showing a construction of a displacement enlarging mechanism of a transducer according to another example of the present invention. The overall displacement enlarging mechanism is an annular and integral member. An annular member 7 includes two annular active vibrators 90*a* and 90*b*. In addition, the annular member 70 is fixed to the diaphragm 5 and the front mass 6 by screws 80*a* and 80*b*, respectively. The displacement enlarging mechanism 70 also enlarges the bending vibration of the bending vibrator 2 through the vibrations of the annular active vibrators 90*a* and 90*b*.

The ring-like members or vibrators and annular members or vibrators above-mentioned are substituted for members and vibrators having polygonal cross-sections (e.g. hexagon, heptagon, octagon, or the like).

The transducer of the present invention can realize the necessary sound pressure level over the wide frequency region.

While the present invention has been described in connection with certain preferred embodiments, it is to be understood that the subject matter encompassed by the present invention is not limited to those specific embodiments. On the contrary, it is intended to include all alternatives, modifications, and equivalents as can be included within the spirit and scope of the following claims.

Further, it is the inventor's intent to refrain all equivalents of the claimed invention even if the claims are amended during prosecution.

What is claimed is:

1. A transducer, comprising:

a vibrator having a front mass, a cylindrical vibrator, and a rear mass that are provided in tandem and that are tightened by a bolt;

a bending vibrator provided apart from the front mass a ring-like member provided in outer peripheral portions of the front mass and the bending vibrator to couple the front mass and the bending vibrator to each other.

2. A transducer according to claim 1, wherein the ring-like member includes a ring-like vibrator.

3. A transducer according to claim 2, wherein the ring-like member and the bending vibrator vibrate synchronously with each other.

4. A transducer according to claim 1, wherein the ring-like member is coupled to the bending vibrator and the front mass.

5. A transducer according to claim 1, wherein the ring-like member comprises a first member coupled to the front mass and a second member coupled to the bending vibrator, and the first member and the second member are coupled to each other.

6. A transducer according to claim 5, wherein the first member and the second member include ring-like vibrators, respectively.

7. A transducer according to claim 5, wherein the bending vibrator and the second member vibrate synchronously with each other with a contact point between the first member and the second member as a fulcrum.

8. A transducer according to claim 5, wherein the bending vibrator vibrates with a position where the second member is coupled to the bending vibrator as a fulcrum.

9. A transducer according to claim 1, wherein the bending vibrator comprises a plate-like member and vibrators that are provided on both faces of the plate-like member, respectively.

10. A transducer according to claim 1, wherein the ring-like member further comprises a convex portion formed thereinside.

* * * * *